United States Patent [19]

Russell

[11] 4,193,632

[45] Mar. 18, 1980

[54] FURNITURE UNIT

[76] Inventor: B. Carson Russell, 12821 Marcy St., Omaha, Nebr. 68154

[21] Appl. No.: 946,122

[22] Filed: Sep. 27, 1978

[51] Int. Cl.[2] ..... A47C 1/12

[52] U.S. Cl. ..... 297/446; 297/440; 297/445

[58] Field of Search ..... 5/122, 127; 297/440, 297/443, 445, 446, 452–454, 456

[56] References Cited

U.S. PATENT DOCUMENTS

| | | | |
|---|---|---|---|
| 2,798,537 | 7/1957 | Bird | 297/446 X |
| 2,798,538 | 7/1957 | Dreifke | 297/440 X |
| 3,743,353 | 7/1973 | Lupinsky | 297/445 |
| 4,052,104 | 10/1977 | Noss | 297/456 |

FOREIGN PATENT DOCUMENTS

| | | | |
|---|---|---|---|
| 2557918 | 9/1976 | Fed. Rep. of Germany | 297/440 |
| 1438493 | 6/1976 | United Kingdom | 297/440 |

*Primary Examiner*—James C. Mitchell

*Attorney, Agent, or Firm*—Hiram A. Sturges

[57] ABSTRACT

A furniture unit adapted for kit-sale and home assembly comprising a horizontal supporting assembly, useful as an open-surfaced seating surface or an open-surfaced table top, and having parallel slats held apart by spacing members and by four legs, threaded compression assemblies extending through and compressing together the slats and legs and spacing members.

The unit having pairs of elongated horizontally spaced connector assemblies each comprising a threaded compression assembly as one connector of a pair and the other connector of a pair can be a dowel, the slats being of wood or of other material expanding with humidity, and each leg being fixed by at least one complete pair of connector assemblies extending therethrough.

The unit described having a back between two back-supporting posts, the posts being integral with two legs to form a chair, the back being formed of major back members separated by back spacers and secured by a pair of connector assemblies as described.

18 Claims, 8 Drawing Figures

FURNITURE UNIT

BACKGROUND OF THE INVENTION

To my knowledge there has never been proposed the concept of a chair or piece of furniture made from thick, strong appearing wooden parallel slats, maintained in position without glue, so that the parts can be bought as a kit and assembled on a living room rug without danger of glue damage, even assembled easily while a person watches television or engages in a family conversation.

To space parallel slats by positions on dowels, maintained by glue between each slat and dowels is a much different way, suitable only for factory assembly, or by persons skillful in handling glue and desirous of hangling glue.

To my knowledge there has been no furniture made in the prior art using parallel wooden slats, separated by parallel wooden spacers, nor has a threaded compression bolt assembly ever been used to compress wooden slats against wooden spacers for achieving the assembling of furniture which need not be glued, and, therefore, which cannot come apart by breakage at glue joints.

I am aware that compression bolts have been used in furniture to hold thermoplastic slats together, and such furniture may be suitable for lawn furniture, but it is not popular as living room furniture, although attractive wooden slats could be a style which, in my opinion, would satisfy many users as suitable living room furniture. It is not simply a matter of exchange of materials, because the massive attractiveness of slats of sizeable cross-section is not practical in plastics, because plastics are expensive and are only affordable in many cases when they are hollow and, therefore, weak and also have visible seams where mould sections come together in manufacture, thus detracting from appearance.

If plastic is made with grooves at the sides, for example, in the form of an "I-beam", then it lacks the solid massiveness of thick wooden slats.

Apart from these factors, most plastic lacks the beauty of wood grain and the use of wood grain in plastics has been affordable mostly on only flat surfaces.

Although there are a few instances in the prior art in which chairs and tables have had recesses extending across horizontal surfaces and disposed in parallelism between the supporting members of the furniture, yet the problems of economically making such furniture have been great in the opinion of the industry and as I understand it.

A particular one of these problems is that wooden furniture made with so many pieces is in danger of coming apart.

The conventional glue construction is simply not adequate in furniture of this type when heavy use is expected. Particularly, this is true of chairs, and it is also true of tables because if tables made of heavy pieces of parallel wood are made in the usual glued together construction, with the only surfaces used in bonding being the surfaces of dowels, then the surfaces are inadequate. Tables are not ordinarily properly used to support weight. But the fact remains that in the course of months' of use many things happen. For example, the massiveness of such furniture would in its appearance tempt persons to sit on it, even though it were in table form. And there is also the danger that someone stumbles and falls against furniture. When the furniture is of the wooden type, using relatively heavy, but completely separate pieces of wood held only by dowels, then the danger of the "pile of slats" coming apart and tumbling down upon such an impact is very great indeed.

Still another problem is humidity change. When the only way that so many separate pieces are secured together in wooden furniture is the proposal of the use of glued dowels, then there is very great danger that the shrinkage of the dowels and of the slats themselves in low humidity situations will be sufficient to cause the glue to crack, the surfaces separate and the furniture becomes only a "pile of sticks".

It is, therefore, an object of the invention to propose furniture made of heavy parallel wooden pieces, which I call slats, which are held together by long bolts, or threaded compression assemblies. Ordinarily, this would not be thought possible because of the necessity of holding the slats apart to retain the "open surfaced beauty" and if small spacers are used between the slats and placed on the bolts, then they would be less desirable than my concepts because such small spacing units would likely be made of a hard substance, and would become compressed into the wood of the slats on each end of a spacer, whereby in the course of time the pressure would be lost and the article of furniture would become loose. This is particularly likely to happen in the case of a chair in which it is not unusual for heavy persons to sit. It is not at all unusual for persons to lean back in a chair. Either of these circumstances would cause the spacers to press into the soft wood of the slats at each end of a spacer, causing the furniture to become loose and undesirable.

I do not know of any instance in the prior art where long compression bolt assemblies have been used to draw together slats of wooden furniture in which the slats themselves are spaced apart by spacers. To go further, I do not know of any instance in the prior art in which wide spacers having great vertical surface areas are proposed to be used between wooden slats and with compression bolt assemblies, which latter would be my concept because of the advantage that the wide spacers would not become compressed into the soft wood of the slats.

I have not known of any instance in the prior art in which parallel slat furniture has been used in which wooden spacers have been employed. Wooden spacers have the particular advantage of beauty. They can match or go with the wood of the slats providing furniture which is suitable for home use, rather than for mere commercial use.

It is an object of this invention to provide furniture which can be made of wood, but which is so durable as to be useful in the hardest commercial use.

A particular object of the invention is to help avoid the great waste of money that is occasioned through the manufacture and purchase of weak, poorly made, easily broken furniture. Home owners tend to have a great amount of capacity for home manufacture of items made and sold to them in kit-form. However, the same persons find it extremely difficult to repair a piece of glued furniture, and with good reason.

It is the common case that glued furniture must be assembled while most of the glued joints are still wet and before they have set up. Most glued furniture requires that the joints be hardening together all at the same time, or at least in groups. Because of this fact it is difficult for the home hobbyist to make furniture by home assembly from kits when the kit itself is of the more conventional type. It is, therefore, an object hereof to provide furniture concepts which will adapt to easy manufacture and easy home assembly both.

The problem of conventional furniture in which repair of sometimes even one glued joint of a chair rung can hardly be done without separating other joints of the chair also is a problem which can be eliminated by the concepts of this invention.

It is an object hereof to provide furniture that does not have to be taken almost completely apart in order to be put together again just in order to fix one, two or three loose joints.

It is an object of this invention to provide furniture which needs substantially no care at all as regards strength.

A particular object is to provide furniture which, if it should become loose, under extremely dry conditions, or with the dryness of great age, can be simply repaired by tightening the nuts of a compression bolt assembly and easily replacing removed bolt assembly hiding plugs.

In the prior art the only furniture concepts proposed, to my knowledge, having horizontally spaced wooden slats have been strong in appearance, but very weak in actuality. Wooden slats can be massive and given the appearance of rugged durability and artistic beauty, which is simply not possible with thermoplastic materials because the volume of the material involved in cross-sectional slats made of wood is so vastly greater than is affordable in the extremely expensive thermoplastic materials.

In the manufacture of thermoplastic materials economy of material is so important that massive appearance is possible at most from only one side or viewpoint and looking at the same piece of furniture from any other angle will show that its components are very skimpy of material.

However, the problem of making heavy slat wooden furniture strong, when the slats must be spaced apart to give the desired effect, is a problem not heretofore answered.

It is desirable that long open spaces exist between adjacent slats. This means that there is no material between the slats at these open spaces whereby a weakness problem could arise.

To use only dowels and glue to bond spaced slats together so as to attempt to depend on the relatively small connection areas of a few dowels, is to invite trouble. Usually for economy the dowels themselves are of wood and, therefore, weak. To make the dowels of any other material than wood would mean that they would perhaps not expand and contract with the wood of the slats and, therefore, separation due to humidity change and ultimate breakage would likely occur if only dowels are used for slat interconnection.

A particular objective is to provide furniture of the attractive massive look of spaced heavy wooden slats which is adapted for kit-sale and home assembly by simply placing a compression bolt assembly through the furniture at the top of each leg and extending over to the opposite leg for drawing slats and spacers together with no tools needed except a single socket wrench which could be supplied with the kit. Further securing can be done in my concept with the use of a dowel at each leg at a horizontal spacing from the compression bolt assembly, the dowel providing economy as compared with the use of an additional compression bolt at each leg with its washers, nuts and assembly time costs.

A particular problem is involved when the legs of furniture are relatively thin transversely of the slats so as not to be thicker than the desired thickness of the spacers. In such a concept the legs themselves are so thin as to be excessively weak when held by means other than compression engaging broad flat vertical surfaces of legs, which latter is especially my concept, my legs having great dimension lengthwise of the slats as compared to their thickness crosswise of the slats.

A particular object also is to provide easy kit assembly or economical factory assembly made possible by avoiding the use of glue. When a compression bolt assembly is used at each leg and completely holds the pieces of that end of the furniture unit together, than I conceive that the dowel can be not only not glued in place but also not tightly fitting. A very loose fit is to be avoided, of course, but the very tight fit which is almost a necessity when the only strength is to be provided by glued dowels is not needed, as I conceive of it, where compression bolt assemblies are used on this wooden furniture, especially when the legs themselves, as well as the spacers, have broad vertical areas, so that the spacers and legs are not caused to press into and compress adjacent surfaces of the slats.

A further objective is to provide a kit for making a furniture unit in which the furniture pieces are prefinished by the factory as made possible by the concept of using compression bolt assemblies in order to hold the wooden parts of the furniture together, rather than glue which would tend to ooze out of places of use, if it were used, destroying some of the pre-finished surfaces.

This is particularly important in kit-furniture because the general public is inexperienced in the use of glue where many surfaces are involved at once. If the glue is of the slow setting type, they may start using the furniture too soon or otherwise cause it to move, thus moving the parts with respect to each other and breaking the glue bond before it is really formed. Elimination of the use of glue has a further advantage that fast setting glues, which some users might try to use, could lead to no end of trouble, because such glues will set up faster than the many pieces can properly be put in place.

There is a great problem in assembling furniture made with tight fitting dowels and yet tight fitting dowels are necessary for strong construction when glued wooden dowels are completely depended upon for the strength of the furniture. Easy-fitting dowels are important to home construction and that is a feature of my furniture concepts.

A further objective is to make the furniture in such a way that only one of the two connectors at each leg has any clue to its existence as the furniture is viewed. I accomplish this by causing one of the connectors not to extend completely through end-most slats. The other connector is prevented from being viewed and all that can be seen as a clue to its existence is an attractive end plug.

A disadvantage of prior art furniture in which spaced parallel slats were held together only by dowels is that end-most slats have been held in place by no means other than dowels and can quite easily come off after the woods have shrunk and the glued joints have become weak.

It has been a common characteristic of furniture held together with glue and dowels that the lower portions of legs must be secured together by rungs or other means. It it an objective hereof to provide legs so strongly held at their tops alone that no connection between the bottom parts of legs is necessary. Beauty is thereby achieved.

In the prior art the only chairs that have had spaced vertically extending members forming the back-rest portions of the chair have not had traditional appearance and have, therefore, not been as desirable for home use, although they might be suitable for commercial use. I propose to achieve conventional appearance by having for the first time the conventional feature of having the back legs of the chair be of one piece with post portions of the chair which extend upwardly from the seating surface and support the back of the chair at the right and left. I propose to make this practical by the placing of a compression bolt assembly extending through the back of the chair for pressing together the major spaced pieces of the back, as well as spacers separating them, so as to make a unitary strong back structure having the conventional appearance feature mentioned.

Still another object is to provide a concept, making practical the pre-finishing of the pieces of the furniture at a factory for the additional advantage that the finish tends to slow down the acquisition of humidity into the wood of the slats and dowels and spacers, whereby it is then the more likely that dowel holes drilled at the factory will not have become excessively tight by the time of assembly at a different location where there is a different humidity.

A further object of this invention is to provide for the possibility of uniformity of slats to reduce inventory problems and make lower costs possible. A chief problem in having uniform slats would be because those certain slats which are adjacent slanting legs would need to have special shapes if completely flat sided legs were to slant outwardly from the center of the furniture unit somewhat. To cause the legs to go straight down in all cases would not be a solution because beauty is needed by slanting certain ones of the legs. Therefore, the slant sided slats could become mixed up with slats which are vertically sided, causing misdelivery problems, especially when kits are being sold, rather than assembled furniture units. Victory was achieved over this problem by the concept of providing the upper ends of the legs with special vertical surfaces, even though those parts of the legs which lie beneath beneath the slats are inclined with respect to the vertical, as achieved by shaping the upper ends of certain legs which are desired to be slanted.

With this method the slats which are abutting an inclined leg can be of the same shape as other slats. This problem and solution is not to be confused, however, with the fact that it may be purposely desirable to have certain rectangular cross section slats of lesser width than other slats for variety in appearance. This latter situation creates no problem, however, because slats which are perhaps half as thick as others are easily recognized.

A speed objective is to provide a chair a good handyman can assemble in less than 10 minutes and disassemble in even less time.

SUMMARY OF THE INVENTION

A chief feature of this invention is to provide the concept of a furniture unit having a horizontal supporting surface made of substantially parallel elongated slats, spacers disposed between and holding apart adjacent slats, some of the spacers being legs extending down below said slats, others of the spacers being of lesser vertical dimension than said legs and, therefore, being called short-spacers, said legs being a pair of right legs and a pair of left legs, first and second pairs of elongated connectors extending through the first and second pairs of legs and also through first and second short-spacers, respectively. The two connectors of each pair of legs being laterally spaced apart of each other.

Another important feature of this invention is having the first one of the connectors being a threaded compression assembly. The second one of the connectors being a dowel free of any glue or direct fastening to at least the majority of the legs and short-spacers and slats it passes through, so that the unit is better adapted for quick assembly and disassembly for kit sale, and especially adapted for persons of limited glue and tools-handling ability.

A further feature is to provide a construction having beauty without sacrifice of ruggedness and economy by providing open spaces between adjacent slats and along the majority of the length thereof.

Another feature being to cause the open spaces to extend completely vertically through the slats in at least ten percent of the space between adjacent slats, and preferably fifty percent or more of such space being open.

Yet another feature is to provide the furniture unit above described for serving as the lower part of a chair, having two upwardly extending back posts, the back posts having a back rest therebetween, having a plurality of vertically elongated back members, spaced apart by backspacers to provide a resemblance to the horizontal supporting surface for attractive appearance.

Still another feature is to provide a plurality of back-connectors curved downwardly somewhat with respect to the horizontal between the posts and also curved rearwardly at the center thereof between the posts for supporting the back-rest members in a comfortable and attractive arrangement.

An important feature is shaping the abutting surfaces of certain ones of the legs and surfaces of adjacent slats so that the legs incline outwardly from the center of the horizontal surface section at the bottom thereof and substantially all along the length thereof beneath the horizontal surface section, a preferred way of doing this is to have the slats adjacent the inclining legs substantially rectangular in cross section, but with the legs provided with vertical surfaces on their sides adjacent the slats, and at the tops of the legs, even though the remainder of each leg has inclining surfaces with respect to the vertical.

DESCRIPTION OF THE PREFERRED EMBODIMENT

Figure 1:
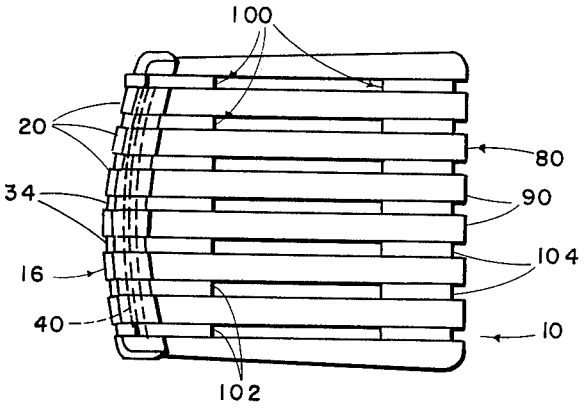
FIG. 1 is a top plan view of the furniture unit which is specifically a chair, certain connectors being shown in dotted lines therein.

A chair of this invention is generally indicated at 10 in FIGS. 1 and 2, and has a back portion generally indicated at 12, having right and left posts 14 which latter are each formed of one piece with rear legs of the lower portion of the chair as later described.

Between the posts 14, a back supporting section, generally indicated at 16, is primarily disposed and comprises a plurality of vertically extending major members 20, which latter have vertical side surfaces disposed in vertical planes extending in parallelism with the posts 14 which latter are themselves provided with vertical right and left side surfaces so as to snugly fit between those major members 20 which are disposed at the ends of a row of major members, such major members being shown at 24 and being against the outer sides of the respective posts 14 whereas other major members 26 are disposed against the innerside of each post 14.

In between each of the major back members 20 other than those which are on each side of the post 14, is an interior back spacing member 34, each having flat vertical plane arm surfaces parallel to the adjacent surfaces of the major members 20.

The posts 14 themselves can be called spacing members or spacers since they also define spacers whereby the spacing members, spacers 34 and 14, as a total, are firmly fixed between their major members 20 by elongated arcuate upper and a lower compression bolt assemblies 40 and 42 respectively which latter are vertically spaced apart and are later more specifically defined. Ends of the compression bolt assemblies 40 and 42 are not visible from the outside of the chair because of plugs 48 in ends of openings receiving the bolt assemblies 40 and 42, such openings being later described.

Figure 2:
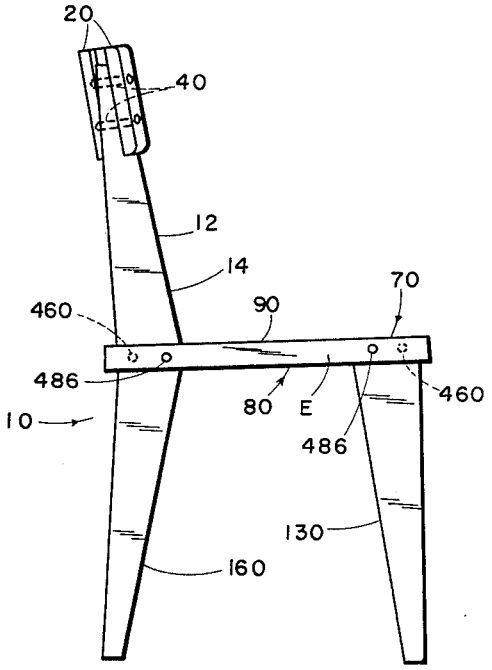
FIG. 2 is a right side elevation of the chair of FIG. 1, as it would be seen from the bottom of FIG. 1, certain connectors being shown in dotted lines.

In FIG. 2, a lower portion of the chair which defines what can be called a furniture unit, generally indicated at 70 of this invention, is shown and is to be distinguished as a matter of terminology from the upper portion of the chair, which is the back portion 16, with its posts 14.

The lower portion of the furniture unit generally indicated at 70 is but a single instance of the use of the term "furniture unit" since the same term can be applied to the entire chair 10 or else to its lower portion only at 70 which contains concepts useful in a manufacture of tables or other units requiring horizontal supporting surfaces.

Figure 3:
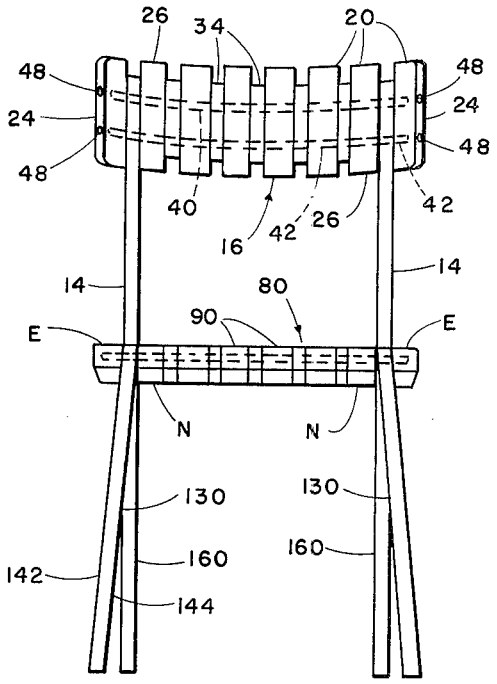
FIG. 3 is a frontal elevation of the chair of FIG. 1 with connectors shown in dotted lines.

The lower portion of furniture unit 70 has a horizontal supporting surface assembly generally indicated at 80 and which has parallel slats 90, each two of which are held apart by front and rear spacers generally indicated at 100 and comprising rear spacers 102 and forward spacers 104 each of which latter has side surfaces preferably disposed in vertical planes parallel to vertical side surfaces of the slats 90, with the exception of the two end-most outward slats 90 which are shown at E in FIG. 3.

Figure 5:
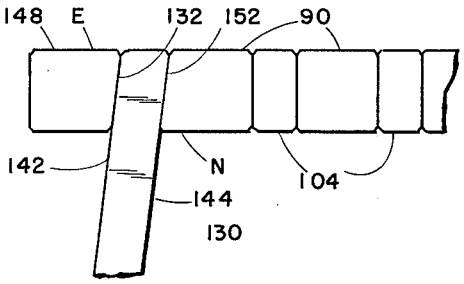
FIG. 5 is a detail showing a corner of the horizontal supporting assembly of the chair as it would be seen adjacent the top of the right leg of a chair, with the remainder of the chair not being shown.

The two end-most outward slats E can be seen in FIG. 3 to have inner surfaces disposed against the outer sides of forward legs 130 of the chair, the inner side surfaces 132 of the outward slats E being best seen in FIG. 5 to be inclined at an angle of approximately 5 degrees with respect to the horizontal, but more importantly at an inclination such that with the leg 130 provided with parallel flat sides 142 and 144 with the outer side 142 disposed in abutment with the inner surface 132 of an adjacent end slat or outward slat E, then the lower end of the leg 130 will have its outer side disposed substantially directly vertically beneath the outermost side 148 of the respective end slat E, whereby the chair can be stored in a storage place against a wall, for example, or can be shipped in a crate against the flat sides thereof without the lower end of the leg 130 protruding sidewise beyond the outer side 148 of the end slat E, and yet the leg having a substantial slant for attractiveness, and also the end slat E not being of greater width on its upper side substantially than the other slats for uniformity of attractive appearance.

For this same reason the construction is such that the end slats E have their outer sides 148 in the same vertical plane also with the outermost sides of the back supporting section 16, whereby a maximum back support is provided proportional to compact storage and shipping of the chair for convenience at times when the chair is not shipped in a kit form.

Referring to FIG. 5, the next innermost slat N of the slats 90, that is, next innermost from the legs 130, has a planar surface 152 on its outer side, which latter is disposed in abutment with the upper part of the inner side 144 of a respective leg 130, the surface 152 being inclined in parallelism with the surface 144 and the surface 132 and the surface 142 for the reasons mentioned.

Figure 6:
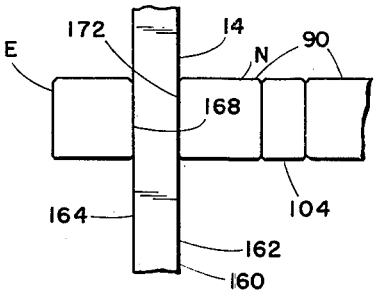
FIG. 6 is a rear elevation of a portion of the horizontal supporting assembly of the chair adjacent to one of the back leg and post assemblies, a portion of which is there shown.

The chair 10 has back legs 160 which are preferably generally vertically extending with flat inner and outer surfaces 162 and 164, as best seen in FIG. 6, the latter surfaces being vertical and the end slats E, as seen in FIG. 6, have inner surfaces 168 at their rearward ends which are vertical and in abutment with the outer surface 164 of a respective leg 160. The rearward end of each next innermost slat N of the slats 90 can be seen in FIG. 6 to have an outer surface 172 which is disposed in a vertical plane and in abutment with the inner surface 162 of the respective rearward legs 160. Since the left post is preferably made of one piece with the left rear leg 160 and the right post 14 is preferably of one piece with the right rear leg 160, each rear leg having a pair of planar vertical sides exactly disposed in the same plane with the respective planar vertical sides of the respective posts 14 so that they could be made of a single piece each of straight lumber.

Figure 7:
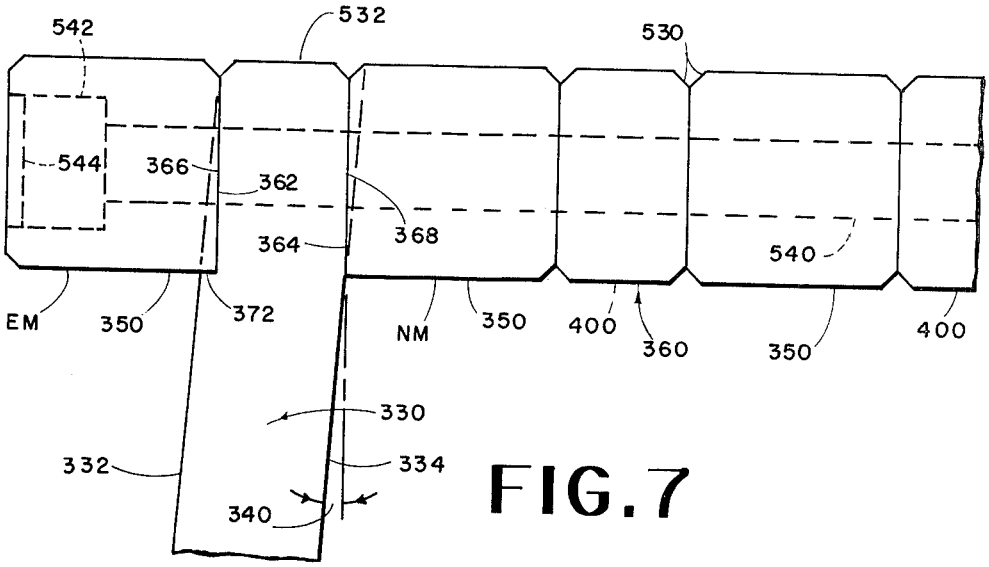
FIG. 7 is a view similar to FIG. 5, but showing a modified leg and horizontal supporting assembly.

Referring to FIG. 7 a modification is there shown in which a special front leg 330 has side surfaces 332 and 334 on the outer and inner sides thereof, respectively, which latter are parallel and which are inclined with respect to the vertical by a very small acute angle 340, which is sufficient, however, to dispose the lower end of the outer side 332 in a position substantially exactly vertically under the outer edge of that one of the slats which is identified as an end slat EM standing for end slat modified. In this respect it is no different from the FIG. 3 modification, in which latter the lower end of the outer surface 142 of the inclined forward leg 130 is disposed directly vertically beneath the outermost edge of the respective end slat E that is thereabove.

In FIG. 3 each leg 130 has an inner surface 144 disposed in a plane in parallelism with its outer planar surface 142. In FIG. 7 the outer and inner surfaces 332 and 334 of the leg 330 are also both planar and parallel beneath the slats 350 of the horizontal supporting surface assembly, generally indicated at 360 in FIG. 7, the latter being the same as the horizontal supporting surface assembly 80 of FIGS. 1 to 5, with the exception that slats EM and NM on each side of a leg 330 are substantially rectangular in cross section, as seen in FIG. 7; whereas, slats E and N on each side of a leg 130 of FIG. 5 are provided with the inclined surfaces 132 and 152 earlier described.

However, in the FIG. 7 modification the slats EM and NM have planar vertical surfaces 362 and 364 which are respectively disposed in abutment with planar vertical surfaces 366 and 368 of the upper end of the leg 330.

It is to be assumed that the other front leg, not shown, of the modification of FIG. 7 inclines outwardly at its lower end.

The surfaces 362 and 368 are vertical and planar and at an inclination with respect to the side surfaces 332 and 334 of the leg 330, such inclination being represented by the angle 340, above described.

To accomplish this a notch 372 is made in the outer side of a leg 330 for receiving the inner side of the end slat EM.

The horizontal supporting surface assembly, generally indicated at 360 in FIG. 7, has spacers 400, which can be considered to be identical to the spacers 100 of FIG. 1 in shape and position.

Figure 8:
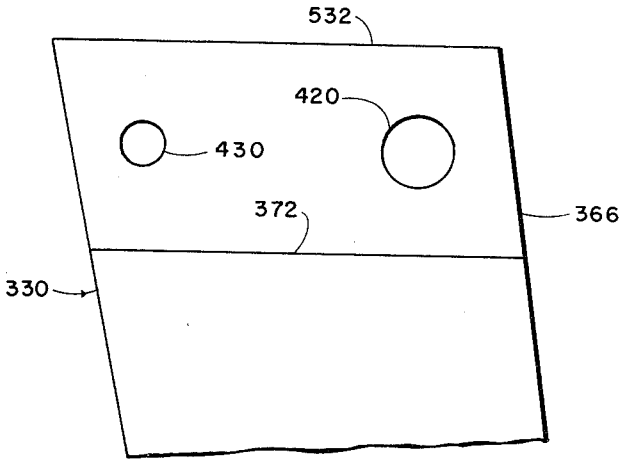
FIG. 8 is a side elevation of the top portion of a leg of the assembly of FIG. 7 as it would be seen from the left side of FIG. 7 with all other parts removed therefrom.

In FIG. 8 the general outline of the upper portion of the leg 330 is shown and the same outline would apply to a leg 130 of FIG. 2, the leg of FIG. 8 having a forward or dowel horizontally extending hole 420 therethrough, extending transversely thereof at a right angle to the surfaces at the sides of each slat 350 such as the surface 366 of FIG. 8. Each front leg 130 of FIG. 2 or 330 of FIGS. 7 and 8 has a second connector hole or compression assembly receiving connector hole 430 therethrough, preferably at the same height as the dowel hole 420 and rearwardly therefrom.

Figure 4:
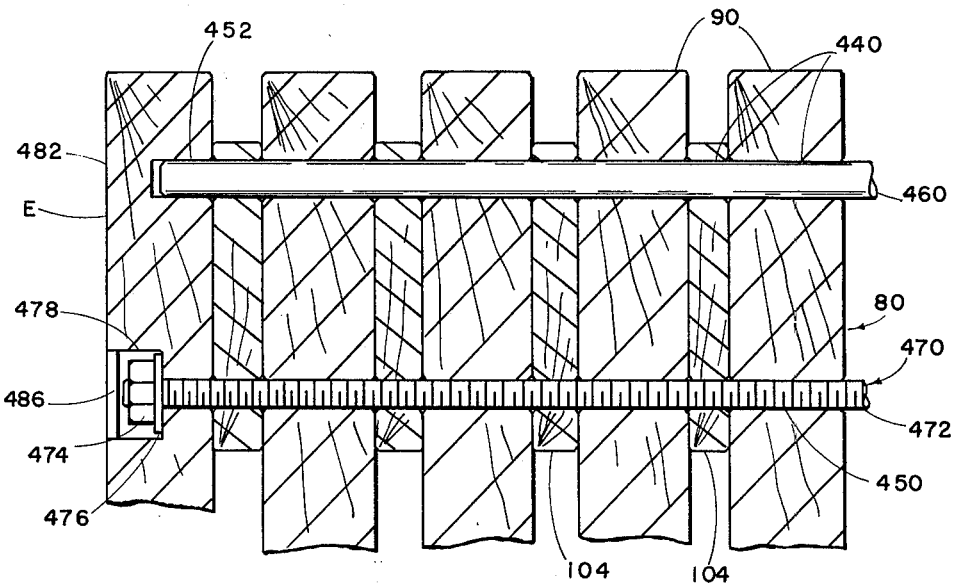
FIG. 4 is a sectional view taken along the line 4—4 in FIG. 2.

In the modification of FIG. 4 there is a dowel hole 440 in each of the slats 90 and in each of the spacers 104, and a compression hole 450 in each of the slats 90 and in each of the spacers 104, with the exception of the end spacer E, which latter has a dowel recess 452 therein, as seen in FIG. 4 on the inner side of the end slat E, so that a dowel 460 in the holes 440 and in the respective end slat recesses 452 cannot be seen, since the slats 450 and spacers 440 are held tight against each other by a compression assembly 470 disposed through the holes 450.

In FIG. 4 the compression assembly 470 can be seen to comprise a threaded shaft 472, having nuts 474 on each end with washers 476 between each nut and the inner side of a nut recess 478, which latter enters the vertical outer side 482 of an end slat E, but does not extend all the way therethrough horizontally, but extends thereinto sufficiently to receive the washer 476 and the nut 474 and sufficiently further that a plug 486 can be received in the recess 478 at its outer end for completely concealing the nut 474 and shaft 472, although the left side of the forward part of the chair is shown in FIG. 4, yet it will be understood that the construction on the right side of the chair is identical thereto.

At the rearward side of the chair the posts 14 are compressed between the end slats E and the next inner slats N in a similar manner as in FIG. 4. This can best be visualized by looking at FIG. 2, in which the position of a plug 486 can be seen, and the hidden position of a dowel can be seen in dotted lines at 460.

It can be seen that the slats 350 and spacers 400 can be provided with beveled edges, as best seen at 530, on all corners to increase the attractiveness of the furniture and the edges of the slats 90, and spacers 104 of FIG. 6 can also be beveled.

The upper surface 532 of a front leg 330 can be on the same level with the upper surfaces of the spacers 400 and slats 350.

In FIG. 7 a dowel position is shown at 540 in dotted lines and a recess 542, identical to the recess 478, for receiving a nut is shown in dotted lines, with the position of a plug 544 identical to the plug 46 being shown in dotted lines.

Referring to FIG. 7, it will be observed that the drawing shows the slats EM and NM as being without a bevel on one of the lower corners adjacent leg 330. This would seem to be the preferred way to make the uniformity of the slats so that they could all be identical to avoid inventory problems. This would then be accomplished by leaving off the bevel 530 from all edges of the slats 350 and spacers 400 which are to be downwardly disposed.

The advantage of the bevel 530 at the tops of the slats and spacers is so that any slight non-alignment of the upper surface of a slat or spacer with an adjacent respective slat or spacer would be less noticeable to the eye in looking downwardly at the tops of the slats and spacers.

I claim:

1. A furniture unit comprising a substantially horizontal supporting surface assembly having spaced substantially parallel elongated slats, spacers disposed between and holding apart adjacent ones of said slats, some of said spacers being short-spacers as measured vertically, other ones of said spacers being legs and longer vertically than said short-spacers, said legs comprising first and second pairs of legs downwardly extending from said supporting surface and disposed one pair adjacent each end of certain ones of said slats whereby one pair of legs define right legs and the other pair of legs define left legs, said first legs being disposed opposite each other on a first line transverse to said slats, said second legs being disposed opposite to each other along a second line transverse to said slats, said second legs being spaced along said slats from said first legs, said short-spacers defining first and second short-spacers disposed between the legs of said first and second pairs of legs respectively, first and second pairs of elongated connectors extending through said first and second pairs of legs respectively and also extending through said first and second short-spacers respectively, the two connectors of each of said pairs of legs being spaced apart laterally of each other, said legs and said short-spacers having horizontally extending holes extending transversely therethrough receiving said connectors respectively.

2. The furniture unit of claim 1 having a first one of the connectors of each respective pair of connectors being a threaded compression assembly compressing the top of its legs towards each other and applying compression force on all slats and short-spacers therebetween.

3. The furniture unit of claim 2 having the second one of the connectors of at least one of each pair of connectors being a dowel free of direct fastening to at least the majority of the legs and short-spacers and slats it passes through so that the said unit is better adapted to be quickly assembled and dissassembled to adapt it for kit-sale and assembly by persons with limited glue and tools-handling ability.

4. The furniture unit of claim 1 having said short-spacers comprising a plurality of pairs of short-spacers arranged one pair between each two adjacent ones of said slats and defining forward and rearward short-spacers respectively, the short-spacers of each pair being spaced along the respective adjacent slats to provide an attractive open space therebetween.

5. The furniture unit of claim 1 having said forward and rearward short-spacers being short enough as measured lengthwise of said slats that at least 10% of the space between adjacent slats is open completely vertically through between adjacent slats.

6. The furniture unit of claim 1 having those upper portions of said legs which are between said slats being made of wood and therefore size-affected by temperature changes.

7. The furniture unit of claim 2 having those upper portions of said legs which are between said slats being made of wood and therefore size-affected by temperature changes.

8. The furniture unit of claim 3 having short-spacers comprising a plurality of pairs of short-spacers arranged one pair between each two adjacent ones of said slats, the short-spacers of each pair being spaced along the respective adjacent slats to provide an attractive open space therebetween.

9. The furniture unit of claim 8 having said short-spacers being short enough as measured lengthwise of said slats that at least 10% of the space between adjacent slats is open completely vertically through between adjacent slats.

10. The furniture unit of claim 1 having portions of said unit below the tops of said slats defining a lower main section, two spaced posts extending upwardly from the rearward side of and connected to said lower main section, back rest means disposed between and connected to said posts, said back rest means comprising a plurality of spaced parallel vertically elongated major back members, certain of said major back members being disposed between said posts, back-spacers disposed between said major back members, back-connector means extending through said posts and through said certain major back members and through said back-spacers.

11. The furniture unit of claim 10 having said back-connector means being primarily stiff and being curved relative to a vertical plane.

12. The furniture unit of claim 11 having said back-connector means also being curved with respect to a horizontal plane downwardly at a center thereof.

13. The furniture unit of claim 10 having right and left end-major-back-members disposed at the right and left sides respectively of said right and left posts, said back-connector means extending through substantial portions of said end-major-back-members also.

14. The furniture unit of claim 10 having the majority of said back-spacers being of lesser size than said major back members as seen in top plan view.

15. The furniture unit of claim 10 having said short-spacers and said back-spacers each being of substantially the same dimension as measured from right to left.

16. The furniture unit of claim 1 having some of said legs inclining with respect to the vertical below said slats in directions respectively away from the center of said horizontal surface as seen looking at each said inclining leg lengthwise of said slats, the abutting surfaces of said certain inclining legs and adjacent surface portions of those ones of said slats which are adjacent said inclining legs being so cooperatively shaped as to cause said inclining legs each to define said inclination, each of said inclining legs having said inclination substantially all along that portion of its length which is disposed below said slats.

17. The furniture unit of claim 16 having said inclined leg-abutting slats being substantially rectangular in transverse cross-section adjacent each of said inclining legs, said inclining legs each having vertical surfaces on sides thereof engaging respective inclined leg-abutting slats.

18. The furniture unit of claim 17 in which those corners of each slat and each spacer which are disposed adjacent another slat or spacer are bevelled so that any small non-alignment of the upper surface of a slat or spacer with an adjacent respective slat or spacer would be less noticeable to the eye in looking downwardly at the tops of the slats and spacers.

* * * * *